US008590243B2

(12) United States Patent
Jorgensen et al.

(10) Patent No.: US 8,590,243 B2
(45) Date of Patent: Nov. 26, 2013

(54) THERMALLY INSULATED BUILDING BRICK

(75) Inventors: Kristian Skovgaard Jorgensen, Roskilde (DK); Roman Rupp, Datteln-Ahsen (DE)

(73) Assignee: Rockwool International A/S, Hedenhusene (DK)

( * ) Notice: Subject to any disclaimer, the term of this patent is extended or adjusted under 35 U.S.C. 154(b) by 72 days.

(21) Appl. No.: 13/124,881

(22) PCT Filed: Oct. 20, 2009

(86) PCT No.: PCT/EP2009/007496

§ 371 (c)(1),
(2), (4) Date: Sep. 6, 2011

(87) PCT Pub. No.: WO2010/046075

PCT Pub. Date: Apr. 29, 2010

(65) Prior Publication Data

US 2011/0308188 A1 Dec. 22, 2011

(30) Foreign Application Priority Data

Oct. 21, 2008 (EP) ..... 08253400

(51) Int. Cl.
*E04B 1/74* (2006.01)

(52) U.S. Cl.
USPC ..... 52/406.1; 52/405.1; 52/405.3; 52/405.4; 52/407.1; 52/407.5

(58) Field of Classification Search
USPC ..... 52/405.1, 405.3, 405.4, 406.3, 406.2, 52/407.2, 407.5, 404.5, 406.1, 407.1, 98, 52/302.3, 747.12
See application file for complete search history.

(56) References Cited

U.S. PATENT DOCUMENTS

| | | | | | |
|---|---|---|---|---|---|
| 3,885,363 | A * | 5/1975 | Whittey | 52/125.3 |
| 4,027,445 | A * | 6/1977 | Nickerson | 52/405.1 |
| 4,071,989 | A * | 2/1978 | Warren | 52/145 |
| 4,073,111 | A * | 2/1978 | Warren | 52/407.1 |
| 4,200,697 | A * | 4/1980 | Blount | 521/83 |
| 4,237,023 | A * | 12/1980 | Johnson et al. | 252/70 |
| 4,259,401 | A * | 3/1981 | Chahroudi et al. | 52/302.3 |
| 4,769,964 | A * | 9/1988 | Johnson et al. | 52/405.4 |
| 4,797,160 | A * | 1/1989 | Salyer | 106/660 |
| 4,988,543 | A * | 1/1991 | Houle et al. | 427/372.2 |
| 5,053,446 | A * | 10/1991 | Salyer | 524/8 |
| 5,062,244 | A * | 11/1991 | Ducharme | 52/98 |
| 5,349,798 | A * | 9/1994 | Gross | 52/405.1 |
| 5,391,019 | A * | 2/1995 | Morgan | 405/129.55 |
| 5,438,171 | A * | 8/1995 | Schmanski | 181/210 |
| 6,235,365 | B1 * | 5/2001 | Schaughency et al. | 428/40.1 |
| 2004/0182037 | A1 * | 9/2004 | Sourlis | 52/606 |

FOREIGN PATENT DOCUMENTS

| | | | |
|---|---|---|---|
| DE | 199 45 482 | A1 | 4/2001 |
| DE | 20 2007 013 074 | U1 | 3/2008 |
| EP | 1 752 593 | A2 | 2/2007 |
| GB | 461314 | A | 2/1937 |
| WO | WO-96/39473 | A1 | 12/1996 |

* cited by examiner

*Primary Examiner* — Chi Q Nguyen
(74) *Attorney, Agent, or Firm* — Tarolli, Sundheim, Covell & Tummino LLP

(57) ABSTRACT

A thermally insulated building brick (1) and a method for production thereof, wherein the brick comprises a structural body (2) with at least one cavity (8) and an insulating filling (3) arranged in the cavity. To provide a brick with high insulation value suited for mass production, the insulating filling comprises an insulating material arranged in a leading-in sheath.

25 Claims, 3 Drawing Sheets

THERMALLY INSULATED BUILDING BRICK

FIELD OF THE INVENTION

The invention relates to a thermally insulated building brick, which brick comprises a structural body with at least one cavity and a thermally insulating filling arranged in the cavity, and further the invention relates to a method for providing a thermally insulated building brick.

BACKGROUND OF THE INVENTION

Although new building materials and building methods have been introduced in the past decades, traditional building bricks are still used and valued. A disadvantage of ordinary building bricks is however that the insulating value is mediocre, which with increasing cost of energy and focus on environment is a major disadvantage. Different attempts have been made to improve the insulation value of building bricks.

At present there are several types of insulated building bricks available on the market. One of these bricks is the Unipor Coriso, which is a brick filled with mineral granulate, and an example of a mineral wool filled brick is known under the trade name MZ8 from Mein Ziegelhaus. Other examples include bricks with a filling of perlite (e.g. Poroton-T8/-T9 from Wienerberger).

Patent literature does also include different concepts for insulated building bricks. One example can be found in GB Patent No. 461,314, which relates to a brick filled with an insulating filling, such as glass wool. This is a traditional building brick filled with traditional insulation materials at the time of filing of this patent more than 80 years ago, and this brick does not meet the demands for modern building bricks in terms of insulation properties and is not suited for mass production.

A more modern example is the building brick according to EP 1 752 593 A2. This building brick has a substantially cubic body comprising a plurality of cavities divided by walls and filled with insulating filling. This prior art building brick does provide state of the art insulation properties, but cannot meet future demands on insulation properties, and further is not perfectly suited for mass production.

DE 20 2007 013 074 U1 discloses vacuum insulation panels having very high insulation value. The vacuum insulation panel comprises a micro-porous core material e.g. a silica-aerogel, possibly with reinforcing fibres, such as inorganic fibres e.g. mineral wool fibres. The core material is arranged in a wrapping, evacuated and provided with an air-tight metal casing, such as an aluminium foil. It is mentioned, but not otherwise supported that the panels can be mounted in cavities of a hollow brick. The resulting brick has a high insulation value, but it is, however, an expensive solution and not suited for mass production. Further the vacuum insulation panel is fragile and subject to damage during mounting in the relatively narrow cavities of a hollow brick. The wrapping and film could for example easily be scratched, whereby the vacuum would be lost and the insulation properties reduced. Such likely damages to the insulation panel will destroy or reduce the insulation properties of the brick. Conventionally such vacuum insulation panels are filled with aerogel for the aerogel to function as an air-absorbent, which will, however, reduce the insulation value of the panel over time.

SUMMARY OF THE INVENTION

An object of the invention is hence to provide an alternative insulated building brick which allows for mass production.

This object is achieved with a thermally insulated building brick according to the introduction, wherein the insulating filling comprises an insulating material arranged in a leading-in sheath. The leading-in sheath will enable easy fitting of the insulating filling in the cavity without damaging the insulating material, thereby facilitating mass production. The insulating filling is adapted to have a first size during installation in the insulated building brick and a second size after installation in the insulated building brick, said sizes being substantially stable and the first size being smaller than the second size.

Normally, the leading-in sheath will be a sheath which mechanically restricts at least one dimension of the insulating filling to allow it to fit into the cavity of the brick. In particular, the restriction on the at least one dimension may be capable of being removed to allow the insulating filling to exert pressure on the inner surface of the cavity of the brick.

The insulating material could be any suitable material having high thermal insulation properties as will be considered by the skilled person. According to an embodiment the insulating material comprises at least one silica-based thermal insulator selected from the group consisting of aerogel, fumed silica and precipitated silica, which are all known to have very good insulation properties. Aerogels are known to have extraordinary insulating properties, but at a high cost. Fumed silica and precipitated silica have lower insulating properties (approximately 22-23 mW/m*K), but at a lower price.

In the present context aerogel should be understood as any of the dried gel products, commonly known as aerogels, xerogels and cryogels. These products are known to have excellent insulating properties, owing to their very high surface areas, high porosity and relatively large pore volume. They are manufactured by gelling a flowable sol-gel solution and then removing the liquid from the gel in a manner that does not destroy the pores of the gel.

Depending on the drying conditions, aerogels, xerogels or cryogels can be made. Where the wet gel is dried at above the critical point of the liquid, there is no capillary pressure and therefore relatively little shrinkage as the liquid is removed. The product of such a process is very highly porous and is known as an aerogel. On the other hand, if the gel is dried by evaporation under subcritical conditions, the resulting product is a xerogel composite. Although shrinkage is unhindered in the production of a xerogel, the material usually retains a very high porosity and a large surface area in combination with a very small pore size.

When the gel is dried in a freeze-drying process, a cryogel is obtained. These conventional aerogel, xerogel and cryogel products, although good insulators, are fragile, susceptible to cracking and require a long processing time.

The term aerogel should also be interpreted as aerogel, xerogel or cryogel products, which additionally comprise a matrix of fibres, the matrix serving to reinforce the material, thereby providing high-strength products. These materials are known as aerogel, xerogel and cryogel matrix composites and are commonly produced in the form of mats, which are typically manufactured by impregnating the reinforcing fibres with a flowable sol-gel solution, gelling and then removing the liquid from the gel in a manner that does not destroy the pores of the gel. Supercritical drying, subcritical drying and freeze-drying result respectively in aerogel, xerogel and cryogel matrix composites.

Aerogels may have a thermal conductivity ($\lambda$-value) of e.g. 9-22 mW/m·K, whereas mineral wool may have a thermal conductivity ($\lambda_D$-value; based on measurements in accordance with European Standard EN 12667 at a reference mean temperature of 10° C.) of e.g. 30-40 mW/m-K, so with addition of aerogels to bricks it is possible to achieve better insulation properties of the building bricks. For comparison perlite will have a thermal conductivity (λ-value) of 45-60 mW/m·K.

The insulating material could be substantially incompressible and the leading-in sheath could be any kind of wrapping of the insulating filling in part or in total to facilitate introduction into the cavities of the brick. According to an embodiment, however, the insulating material is compressible and the leading-in sheath is a substantially gas impermeable film arranged as an enclosure around the insulating material. By compressible should be understood that the insulating material can be compressed by at least 5%, preferably at least 10% of its volume or nominal thickness, without substantial damage to the insulating material. By substantially gas impermeable should be understood that the film will restrict gas flow to such an extent that the film will allow a pressure difference, such as 50 kPa, across the film to be maintained for at least 10 minutes, preferably at least 1 hour. Hereby it is possible to at least partially evacuate the enclosure, whereby the enclosure and the insulating material will compress and thereby enable easy fitting of the insulating filling in the cavity of the brick.

A total enclosure of the insulating material further has the advantage that a loose insulating material can be used without risk of insulating material escaping the cavity, any potential dust problems during manufacture etc.

It could be an advantage if the pressure difference is maintained for a significant period, such as at least a week, as the insulating filling could hence be compressed for cost-efficient transport and storage and still be compressed at time of introduction into the cavities of the brick. On the other hand it could be advantageous for the pressure difference to be neutralized quickly, e.g. within a few minutes or shorter, for the insulating filling to expand quickly after being introduced into the cavity. This would eliminate the need for perforating the film to expand the insulating filling in the cavity for securing the insulating filling in the cavity.

The insulating filling may be sized to the corresponding cavity of the brick to provide a loose fit, which will enable easy fitting of the element in the cavity. According to an embodiment, however, the size of the insulating filling is adapted for a tight fit in the corresponding cavity. This is a particularly simple and cost effective way of anchoring the filling in the cavity of the brick. A further advantage is that the insulation and fire properties of the brick are not influenced by any additional adhesive or binder for bonding the insulating filling to the brick. With a tight fit the insulating filling will be held in place in the cavity by friction between the insulating filling and the cavity walls.

The insulating filling may further comprise additional materials, such as organic or inorganic fibres. According to an embodiment the insulating filling comprises mineral fibres, such as glass fibres, stone fibres or slag fibres, which can provide extra strength to the filling.

The insulating filling is adapted to have a first size during installation in the insulated building brick and a second size after installation in the insulated building brick, said sizes being substantially stable and the first size being smaller than the second size. By size should be understood any dimension (length, width, height), which has an impact on the ease of fitting the insulating filling in the cavity of the brick. As an example the insulating filling may be compressed to have a smaller width, if the width of the insulating filling determines whether it fits into the cavity, whereas other dimensions may be unchanged or even increased. As an example the insulating filling may be stretched longer to have a smaller width, to allow easy installation, if the width of the insulating filling determines whether it fits into the cavity, whereas the length has no influence.

A binder may be added to the insulating material of the insulating filling if considered advantageous. The binder may be organic or inorganic. An example of an inorganic binder is water glass, which has good fire properties.

The brick may comprise a single cavity, but according to an embodiment the brick comprises a plurality of cavities, and all cavities are filled with insulating filling. Hereby a high strength brick with high insulation value is provided. To provide high strength the brick should be as massive as possible, whereas to provide good insulation value the brick should be filled with as much insulation material as possible.

The brick could be any kind of building brick made of any kind of material, e.g. burnt clay, concrete, cellular concrete etc. According to an embodiment the structural body is made of mainly lime (CaO) and sand ($SiO_2$), resulting in a so-called sand-lime brick. The production method of these bricks will provide the advantage that curing of the bricks may take place in an autoclave at relatively low temperatures of around 200° C. Thereby it is possible to arrange the insulating filling in the cavity of the brick before curing of the brick, which may facilitate cost efficient production.

The invention also relates to a method for providing a thermally insulated building brick, said method comprising the steps of providing a structural body having at least one cavity, providing an insulating filling comprising an insulating material arranged in a leading-in sheath, and arranging the insulating filling in the cavity. With this method a brick having high insulation value can be produced effectively, as the insulating filling will be easier to install in the cavity due to the leading-in sheath, and further the insulating filling will be protected during installation in the cavity, which might otherwise pose damage to the insulating filling.

The insulating material could be substantially incompressible and the leading-in sheath could be any kind of wrapping of the insulating filling in part or in total to facilitate introduction into the cavities of the brick. For example insulating filling could be provided in roll-form and the leading-in sheath could be a belt to keep the roll form during introduction in the cavity. After introduction the belt could be cut to enable the roll to expand to fit the cavity. According to an embodiment, the insulating material is compressible and the leading-in sheath is a substantially gas impermeable film arranged as an enclosure around the insulating material, and the method comprises the intermediate step of applying reduced pressure to the enclosure. This enables a particularly efficient way of introducing the insulating filling as the filling is compressed during fitting and can subsequently expand to completely fill the cavity.

According to an embodiment the method comprises the further step of at least partly releasing the reduced pressure of the enclosure, whereby the insulating filling will instantly expand to fill the cavity.

According to an embodiment the method comprises the step of providing the insulating material by selecting at least one silica-based thermal insulator from the group consisting of aerogel, fumed silica and precipitated silica, whereby a brick with high thermal insulation value can be achieved.

The brick could have any suitable dimension as would be understood by the skilled person.

BRIEF DESCRIPTION OF THE DRAWINGS

The invention will be described in more detail in the following by way of example and with reference to the schematic drawings in which.

DESCRIPTION OF PREFERRED EMBODIMENTS

Figure 1:
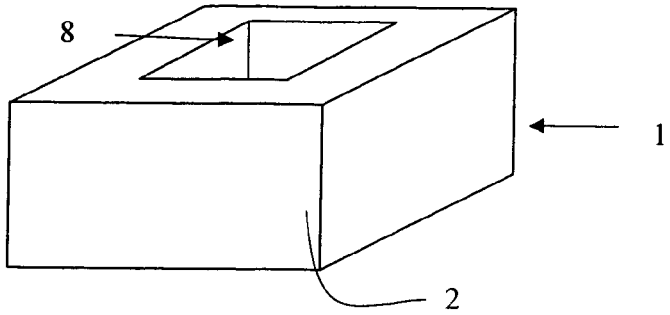
FIG. 1 is a perspective view of a hollow building brick.
Figure 2:
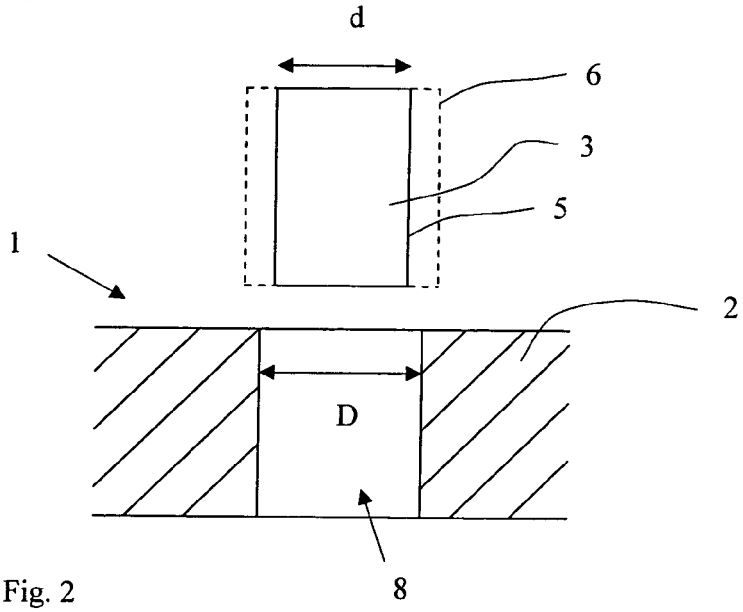
FIG. 2 is a sectional view of a hollow building brick at insertion of a thermally insulating filling.

A building brick 1 is shown in FIG. 1, which brick 1 comprises a structural body 2 with a cavity 8. The structural body 2 of the brick according to this simple embodiment is a traditional building brick made of burnt clay. FIG. 2 illustrates a step of inserting a thermally insulating filling 3 in the cavity 8 of the brick 1. The thermally insulating filling 3 is compressed from a second size 6 (shown in dashed line) to a first size 5 for installation of the filling 3 in the cavity 8. As can be seen the first size 5 has a smaller dimension d than the dimension D of the cavity 8.

Figure 3:
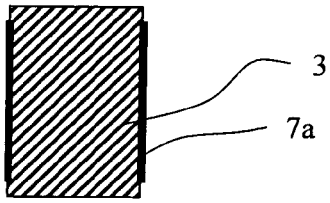
FIG. 3 is a cross-sectional view of a thermally insulating filling for a brick.

FIG. 3 illustrates a thermally insulating filling 3 in cross-sectional view. The thermally insulating filling 3 comprises an insulating material, which is arranged in a leading-in sheath. In the present embodiment the leading-in sheath is in the form of a band 7*a* wrapped around the insulating material, and holding the insulating material in a compressed state for easy introduction in the cavity. The insulating material could in this embodiment be provided in roll form. After introduction in the cavity the band 7*a* could be torn for the thermally insulating filling to expand to fill the cavity (not shown).

Figure 4:
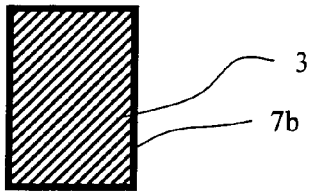
FIG. 4 is a cross-sectional view of an alternative thermally insulating filling.

An alternative leading-in sheath in the form of an encapsulating film 7*b* is shown in the cross-sectional view of FIG. 4. With an encapsulating film 7*b* it is possible to at least partially evacuate the interior of the filling 3, thereby compressing the filling for easy introduction in the cavity of the brick.

Figure 5:
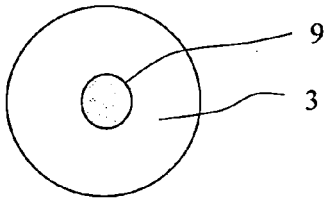
FIG. 5 is a top view of the thermally insulating filling.

Evacuation of the filling 3 can be done in a number of ways. One simple example is shown in FIG. 5, which is a top view of a cylindrical thermally insulating filling 3 in an encapsulating film. The encapsulating film has an opening 9, which can be used for evacuation purposes. Alternatively the encapsulating film 7*b* of the thermally insulating filling could be provided with a suitable valve.

Figure 6A:
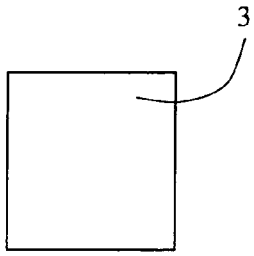
FIG. 6*a* is a side view of the thermally insulating filling.
Figure 6B:
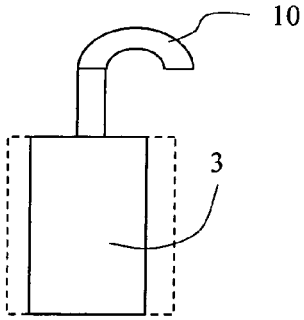
FIG. 6*b* is a side view corresponding to FIG. 6*a*, with the thermally insulating filling under compression.

Compression of the thermally insulating filling 3 by evacuation is illustrated in the schematic side views of the thermally insulating filling 3 in FIGS. 6*a* and 6*b*. In FIG. 6*a* the thermally insulating filling 3 is shown in the uncompressed state, whereas in 6*b* the thermally insulating filling 3 is compressed to a smaller size by means of a suction device 10 connected to the opening 9. The smaller size is shown in full-drawn line, whereas the uncompressed size is shown in dashed line.

Figure 7:
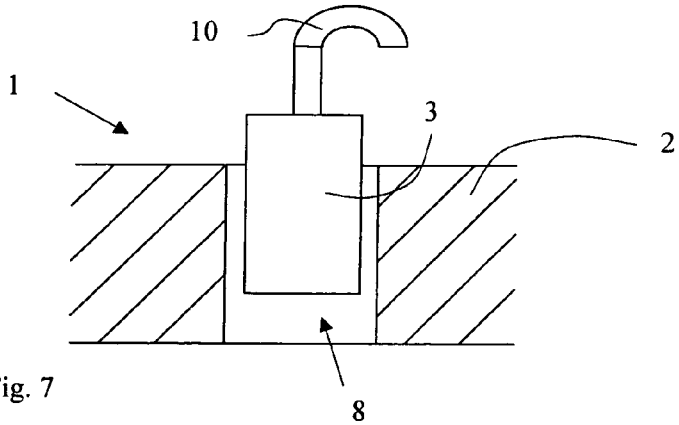
FIG. 7 shows a step during insertion of the thermally insulating filling in a brick.

Insertion of the thermally insulating filling 3 is shown in the cross-sectional view of FIG. 7. In the illustrated example the suction device 10 is still connected to the thermally insulating filling 3 for constant evacuation in order to keep the insulating filling compressed. In this case the suction device 10 may be a suction disc forming part of a transport device for grasping, compressing and inserting the thermally insulating filling 3 in the cavity. When disconnecting the suction device 10, the compressed thermally insulating filling 3 would expand to fill the cavity.

Figure 8:
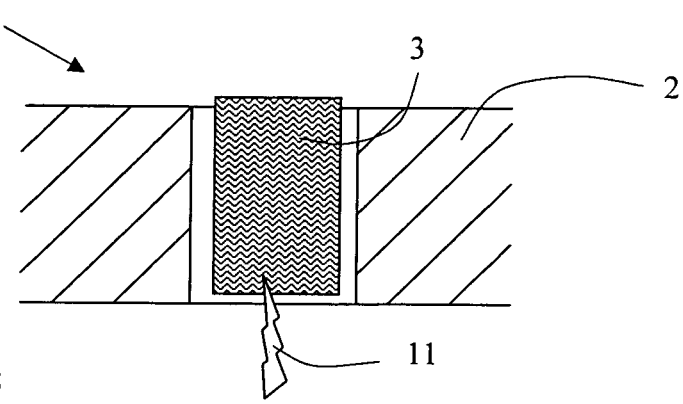
FIG. 8 shows a step after insertion of the thermally insulating filling in the brick.
Figure 9:
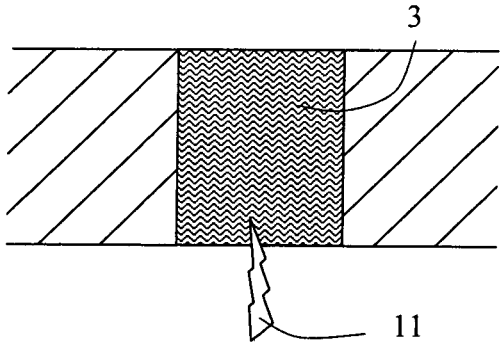
FIG. 9 shows a final step of expansion of the thermally insulating filling in the brick.

Alternatively the suction device 10 could be used only for evacuation/compression of the thermally insulating filling 3, whereupon the opening 9 of the encapsulating film 7*b* could be sealed off to maintain compression. In this case it may be necessary to puncture the encapsulating film 7*b*, e.g. using a pointed tool 11 as shown in FIGS. 8 and 9 for the thermally insulating filling 3 to expand to fill the cavity of the brick 1. Alternatively the encapsulating film 7*b* or the seal covering the opening 9, could be gas permeable, so the vacuum inside the thermally insulating filling 3 would be lost in relatively short time, e.g. a few minutes or hours, so the insulating filling 3 would slowly expand to the second size 6 after installation in the cavity.

Although the leading-in sheath will normally have a limited thickness, and hence only a limited influence on the thermal properties of the brick with insulating filling, it is preferred that the sheath is made of a material with low thermal conductivity, or alternatively that the sheath is removed after installation of the insulating filling.

The invention claimed is:

1. A thermally insulated building brick (1) comprising:

a structural body (2) with at least one cavity (8) and an insulating filling (3) arranged in the cavity, wherein the insulating filling (3) comprises an insulating material arranged in a leading-in sheath surrounding a perimeter of the insulating filling (3), the insulated filling being adapted to have a first size (5) during installation in the insulated building brick and a second size (6) after installation in the insulated building brick, said sizes being substantially stable and the first size being smaller than the second size.

2. A thermally insulated building brick (1) according to claim 1, wherein the insulating material comprises at least one silica-based thermal insulator selected from the group consisting of aerogel, fumed silica and precipitated silica.

3. A thermally insulated building brick (1) according to claim 1, wherein the insulating material is compressible, and the leading-in sheath is a substantially gas impermeable film arranged as an enclosure around the insulating material.

4. A thermally insulated building brick (1) according to claim 3, wherein the size of the insulating filling (3) is adapted for a tight fit in the corresponding cavity (8).

5. A thermally insulating block according to claim 3, wherein the leading-in sheath includes one of an opening and a valve for regulating the pressure within the enclosure.

6. A thermally insulated building brick (1) according to claim 1, wherein the insulating filling (3) further comprises organic or inorganic fibres, or a mixture thereof.

7. A thermally insulating brick (1) according to claim 6, wherein the insulating filling comprises mineral fibres.

8. A thermally insulating brick (1) according to claim 7, wherein the mineral fibres are glass fibres, stone fibres or slag fibres.

9. A thermally insulated building brick (1) according to claim 1, wherein the insulating filling (3) further comprises a binder.

10. A thermally insulating brick (1) according to claim 9, wherein the binder is an inorganic binder.

11. A thermally insulating brick (1) according to claim 10, wherein the inorganic binder is water glass.

12. A thermally insulated building brick (1) according to claim 1, wherein the brick (1) comprises a plurality of cavities (8), and all cavities are filled with insulating filling (3).

13. A thermally insulated building brick (1) claim 1, wherein the structural body (2) is a sand-lime brick.

14. A thermally insulating block according to claim 1, wherein air is evacuated from the interior of the leading-in sheath prior to installation such that the insulated filling maintains the first size.

15. A thermally insulating block according to claim 1, wherein a vacuum is formed within the leading-in sheath to reduce and maintain the insulating filling at the first size.

16. A thermally insulated building brick according to claim 1, wherein the leading-in sheath wraps entirely around the insulating filling to maintain the insulated filling at the smaller first size during installation.

17. A thermally insulated building brick according to claim 1, wherein the leading-in sheath encapsulates the insulating filling to maintain the insulated filling at the smaller first size during installation.

18. A method for providing a thermally insulated building brick (1), said method comprising the steps of:

providing a structural body (2) having at least one cavity (8), providing an insulating filling (3) comprising an insulating material adapted to have a first size (5) during installation in the insulated building brick and a second size (6) after installation in the insulated building brick, said sizes being substantially stable and the first size being smaller than the second size, positioning the insulating filling (3) within a leading-in sheath during installation to compress the insulating filling (3) to the first size, and arranging the insulating filling (3) within the leading-in sheath in the cavity (8).

19. A method according to claim 18, wherein the insulating material is compressible and the leading-in sheath is a substantially gas impermeable film arranged as an enclosure around the insulating material, and the method comprises the intermediate step of reducing the pressure within the enclosure.

20. A method according to claim 19, wherein the method comprises the further step of at least partly releasing the reduced pressure of the enclosure.

21. A method according to claim 18, wherein the method comprises the step of providing the insulating material by selecting at least one silica-based thermal insulator from the group consisting of aerogel, fumed silica and precipitated silica.

22. A method according to claim 18, wherein the method comprises the further step of applying a vacuum to the interior of the insulating filling to give the insulating filling the first size and maintain the insulating filling at the first size.

23. A method according to claim 18, wherein the method comprises the further steps of providing the leading-in sheath with one of an opening and a valve; and sealing off the leading-in sheath after applying the vacuum to the interior of the leading-in sheath in order to maintain the insulating filling at the first size.

24. A method according to claim 18, wherein positioning the insulating filling within the leading-in sheath comprises wrapping the leading-in sheath entirely around the insulating filling to maintain the insulated filling at the smaller first size during installation.

25. A method according to claim 18, wherein positioning the insulating filling within the leading-in sheath comprises encapsulating the insulating filling within the leading-in sheath to maintain the insulated filling at the smaller first size during installation.

* * * * *